United States Patent [19]

Shannon et al.

[11] 4,019,802

[45] Apr. 26, 1977

[54] FIELD-APPLIABLE UHF COAXIAL CONNECTOR

[75] Inventors: Suel Grant Shannon, Harrisburg; Harold Chester Timmins; Kenneth Earl Gookin, both of Hershey, all of Pa.

[73] Assignee: AMP Incorporated, Harrisburg, Pa.

[22] Filed: Nov. 4, 1975

[21] Appl. No.: 628,640

[52] U.S. Cl. ..... 339/177 R; 339/89 R

[51] Int. Cl.[2] ..... H01R 17/18

[58] Field of Search ..... 339/89 C, 90 C, 91 P, 339/177 R, 177 E, 163 R

[56] References Cited

UNITED STATES PATENTS

| | | | |
|---|---|---|---|
| 2,805,399 | 9/1957 | Leeper | 339/177 UX |
| 3,077,513 | 2/1963 | Felts | 339/177 UX |

*Primary Examiner*—Roy Lake
*Assistant Examiner*—E. F. Desmond
*Attorney, Agent, or Firm*—Allan B. Osborne

[57] ABSTRACT

This invention relates to a ultra high frequency (UHF) coaxial connector that can be applied to the end of a coaxial cable in the field by an inexperienced layman using only pliers. More particularly, the invention consists of a coupling nut having internal threads for mating with an antenna jack or the like, a shell around which the coupling nut fits and a center contact unit which fits into the shell. Included in the unit is a center contact into which is positioned the coaxial cables center conductor and, surrounding the contact, a dielectric which fits into the shell trapping the coaxial cable's braided shield thereinbetween.

3 Claims, 11 Drawing Figures

FIG 6b
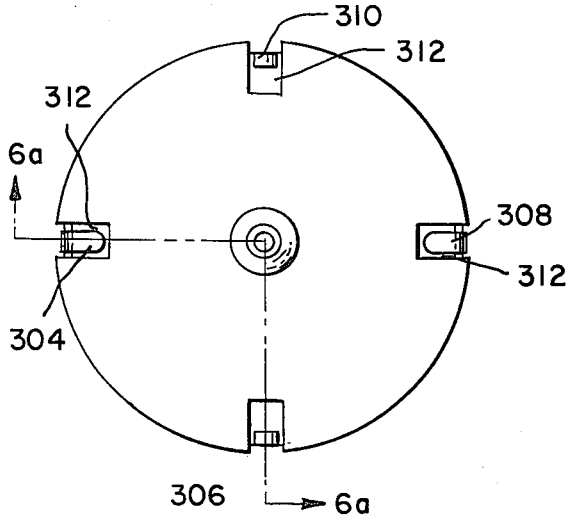
FIG 7b
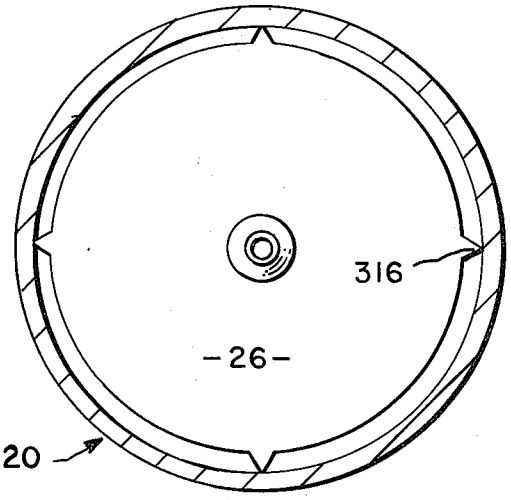
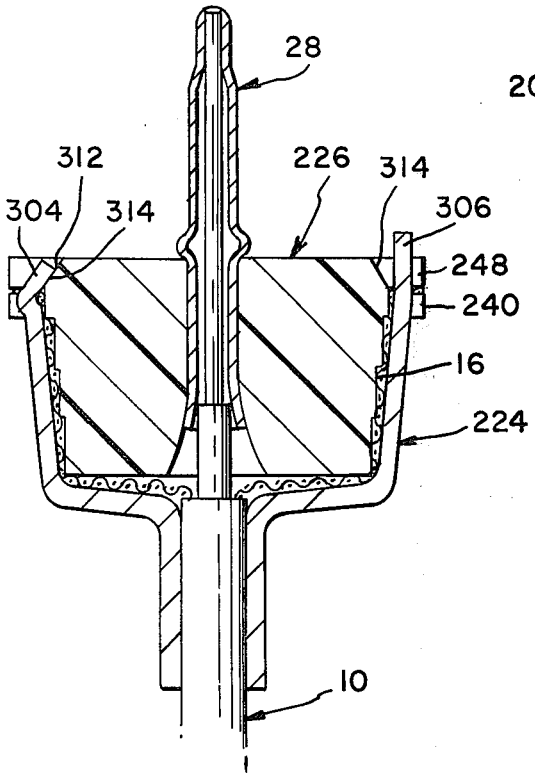
FIG 6a
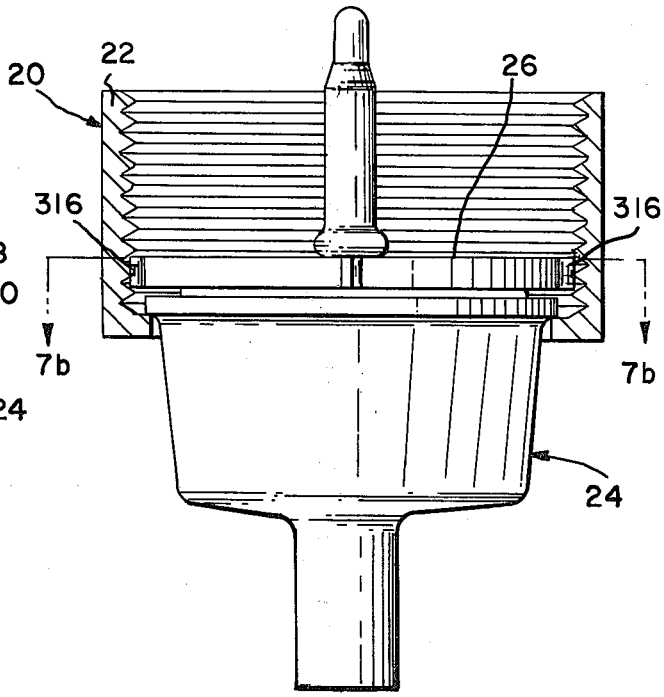
FIG 7a

FIELD-APPLIABLE UHF COAXIAL CONNECTOR

BACKGROUND OF THE INVENTION

For many years, connectors used in radios and other high frequency applications were attached to coaxial cable by soldering initially and more recently by crimping. These connectors or plugs generally consisted of an outer shell member to which the braided shield conductor of the cable was fastened, a dielectric insert which was secured within the shell and which in turn held a contact member in which the coaxial cable's center conductor was crimped, and a coupling nut, loosely fitted over the outer shell for threadably connecting the plug to the jack or to a mating connector. Patents disclosing these types of UHF connectors include U.S. Pat. Nos. 3,297,979 and 3,245,027. In both patents the braided shield conductor is expanded radially outwardly and fitted over a rearward extension of the shell members. A ferrule is then slid over the shield conductor and crimped down so as to trap the braided shield conductor between it and the rearward extension.

These kinds of UHF connectors and the method of assembly requires crimping tools of some complexity. While such are found in manufacturing facilities they are not ordinarily available to the general public.

Until recently, those persons who had a need to assemble a UHF connector in the home environment were radio hams and the like who possessed a great deal of knowledge concerning such connectors and were adept at using soldering irons and other like tools. Therefore there was no great demand for a more easily assembled UHF connector.

Very recently the Federal Communications Commission has made a frequency span available for transceiving use by the general public. Immediately thereafter transceivers utilizing the available frequencies came on the market and were an almost instant success. The popularity of the citizen band (CB) radios created an unanticipated demand for an UHF connector which could be assembled by a layman who had access only to normal household tools.

Accordingly it is an object of the present invention to provide an UHF connector which can be assembled onto a coaxial cable using a pair of pliers.

Another object of the present invention is to provide an UHF connector which is field appliable and is able to withstand considerable tensile forces thereon without failure.

Still another object of the present invention is to provide an UHF connector having reliable conductive continuity from the braided shield to the outer shell of the connector.

Yet another object of the present invention is to provide an economical field appliable UHF connector having reliable continuity between the center conductor of the coaxial cable and the center contact of the connector.

These and other objects and advantages of the present invention will become readily apparent upon reading the following description in conjunction with the accompanying drawings.

Figure 3:
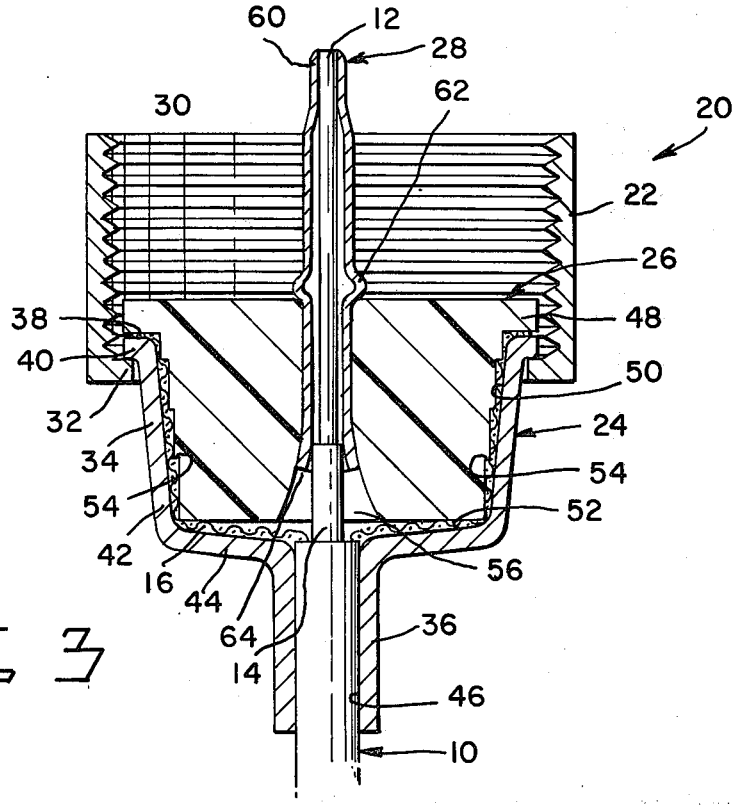
FIG. 3 is a cross-sectional view of the preferred embodiment of the field appliable UHF connector of the present invention.
Figure 5:
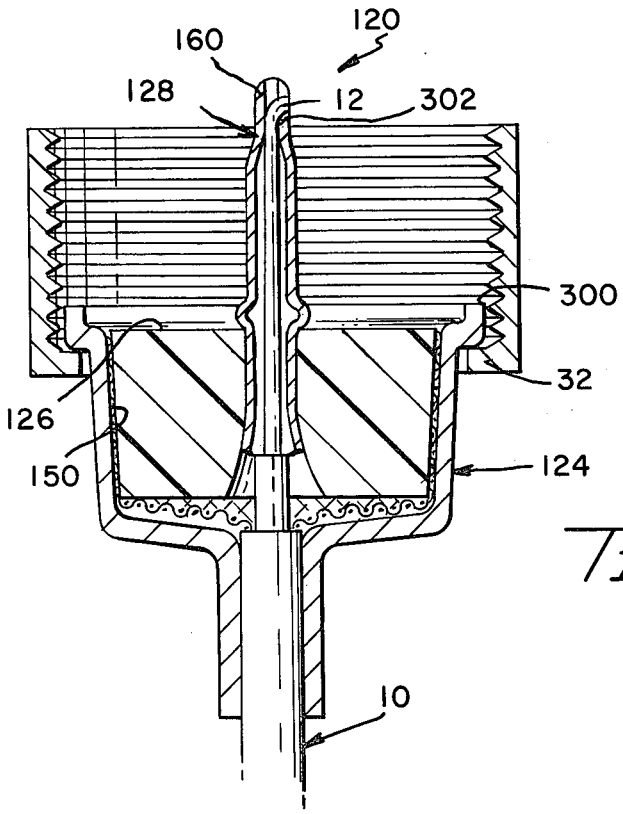

FIGS. *4a*, *4b* and *4c* illustrate the assembly of the preferred embodiment of FIG. 3 to a coaxial cable;

FIGS. 5, *6a* and *6b* are other embodiments of a field appliable UHF connector of the present invention; and FIGS. *7a* and *7b* illustrate a method of holding the several components of the field appliable UHF connector together during shipping to the user.

DESCRIPTION OF THE PRIOR ART

Figure 1:
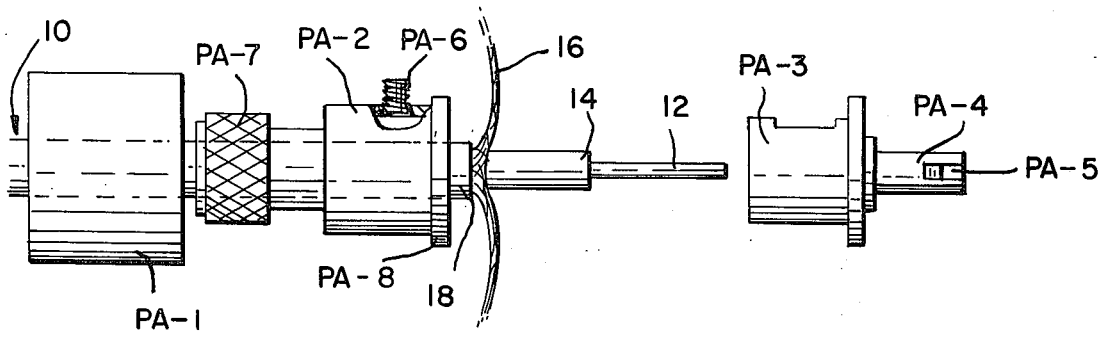
FIGS. 1 and 2 illustrate the prior art field appliable UHF connector.

FIG. 1 is an UHF connector developed by Avanti R & D, Inc. of Addison, Illinois. It has a coupling nut PA-1, a shell member PA-2, a dielectric PA-3 and a hollow center contact PA-4 fixed in the dielectric. The center contact has a slot PA-5 at its forward end. The shell member PA-2 has a threaded aperture which receives a set screw PA-6. Further, the back end of the shell member has a knurled section PA-7.

The coaxial cable 10 used with the several field appliable UHF connectors has a center conductor 12, an inner insulation 14 surrounding the center conductor, and a braided metal outer conductor or shield 16 surrounding insulation 14. A tough outer insulating jacket 18 covers the shield.

The Avanti UHF connector of FIG. 1 is assembled to the coaxial cable by first threading the coupling nut PA-1 and shell member PA-2 onto cable 10. Decreasing lengths of the cable's jacket 18, shield 16 and insulation 14 are removed to expose appropriate lengths of the center conductor 12 and shield 16. The exposed shield is flared radially outwardly. The center conductor 12 is inserted into and through center contact PA-4 until dielectric PA-3 abuts the flared shield. The end of the conductor 12 is bent into slot PA-5 and the excess trimmed off. The shield is then wrapped about dielectric PA-3 and shell member PA-2 slid forward over the shield-wrapped dielectric until the dielectric bottoms in the shell member. The set screw PA-6 is then threaded down through the aperture to bear against the shield and dielectric, thereby securing it against pull-out. The coupling nut PA-1 is retained on the cable by cooperation between an outwardly extending flange or lip PA-8 on shell member PA-2 and an inwardly extending flange (not shown) on the back end of the coupling nut.

Figure 2:
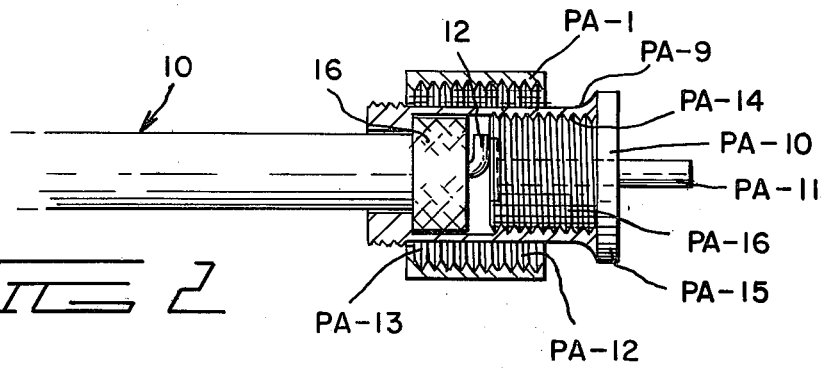

The second prior art field appliable UHF connector shown in FIG. 2 is manufactured by L-Coil Research of Brighton, Mich. It has a coupling nut PA-1, a shell member PA-9, a dielectric PA-10 with a solid center contact PA-11 staked therein, and an insulating aperture disc hidden by the braided shield 16. The coupling nut is structurally the same as the one in FIG. 1. The cross-sectional view of FIG. 2 shows the internal threads PA-12 and inwardly projecting flange PA-13. Shell member PA-9 is flared somewhat at its front end and its surface at its back end is knurled. It also has internal threads PA-14 at its front end. Dielectric PA-10 has a radially extending flange PA-15 at its forward end and has external threads PA-16 which mate with internal threads PA-15. The center contact has a radially enlarged end exposed at the back of the dielectric as seen in the drawing.

The L-Coil UHF connector is assembled by first threading the coupling nut and shell member onto coaxial cable 10. Incidentally, the coupling nut is retained on the shell member between the knurled section and the flared front end. The cable is stripped to bare suitable lengths of the center conductor 12 and shield 16. After flaring the shield outwardly the disc is pushed on with the center conductor extending through the aperture. The end of the conductor is bent over and the shield wrapped over the disc as shown. Shell member PA-9 is then pushed forward over the shield-wrapped disc and dielectric PA-10 threaded into the member until its retained center contact PA-11 bears against the bent over center conductor.

DESCRIPTION OF THE PREFERRED EMBODIMENT

FIG. 3 is a cross-sectional view of the field appliable UHF connector 20 constructed in accordance with the preferred embodiment of the present invention. The several components of connector 20 include the coupling nut 22, shell member 24, dielectric 26 and center contact 28.

Coupling nut 22 contains internal threads 30 and, at its back end has a flange 32 extending radially inwardly. As a comparison will show there are no structural differences between coupling nut 22 and prior art coupling nuts.

Shell member 24 has a wide cup-shaped forward portion 34 and a small cylindrical rearward extension 36. The leading edge 38 of the forward portion is formed into a circumferential flange 40 extending radially outwardly. As the drawing shows, the flange 40 cooperates with flange 32 on the coupling nut to limit the forward movement of the nut.

The walls 42 of the forward portion 34 converge toward the rearward extension. The angle of convergence is preferably about three degrees with respect to the longitudinal axis of the connector 20. The angle can be as high a 6°. The trailing edge or base 44 of the forward portion is normal to the longitudinal axis and preferably is gently concave on its inside surface. An opening is centrally positioned in the base.

The rearward extension 36, an integral part of the shell member, is elongated and has a passageway 46. The passageway opens into the opening in the base of the forward portion. Dimensionally the diameter of the passageway and opening preferably approximates the outer dimension of coaxial cable 10.

The coupling nut and shell member are preferably formed from brass.

Dielectric 26 is a solid cup shaped body formed from insulating material such as phenolic. The forward end, or face projects radially outwardly to provide a flange 48. The side walls 50 are gently tapered inwardly from the flange to the base 52 of the dielectric. The degree of taper is the same as the angle of convergence on the shell member. Additionally the walls are provided with a series of steps 54. The center of the dielectric is hollowed out to provide a passage 56 therethrough. The walls of the passage adjacent the base may be widened as shown to facilitate the inseertion of the center contact 28.

Center contact 28 is formed from a conductive metal such as brass into an elongated cylindrical member having a passageway 58 extending through it. The front end of the contact is reduced in diameter to provide a nose 60. The contact is upset about halfway along its length to provide a retaining ring 62. The contact is fixed in the dielectric by pushing it into the passage 56 from the front until ring 62 arrests further rearward movement. The back end 64 of the contact is flared outwardly as shown to lock the contact in the dielectric.

Figure 4A:
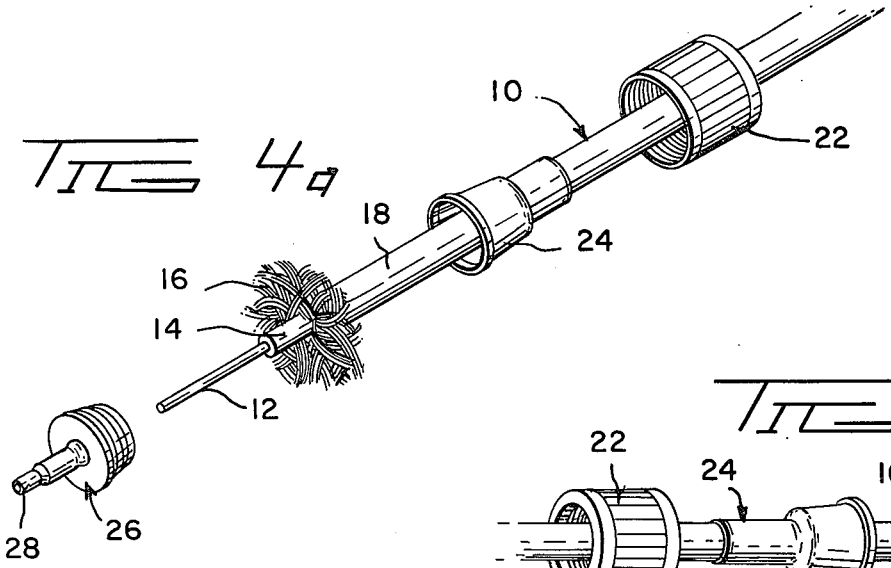

FIGS. 4*a*, *b* and *c* illustrate the steps taken in terminating coaxial cable 10 onto UHF connector 20. Coupling nut 22 and shell member 24 are slid onto the end of the cable in that order. Various lengths of jacket 18, braided shield 16 and inner insulation 14 are removed and the exposed shield flared out, as shown in FIG. 4*a*.

Figure 4B:
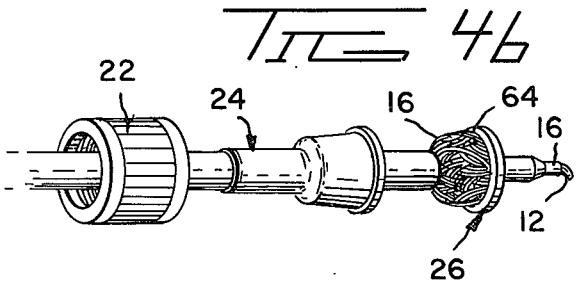

The center conductor 12 is then inserted into the center contact 28 so that the end extends beyond nose 60. This protruding end is bent over the nose as shown in FIG. 4*b*.

The braided shield 16 is then formed or wrapped about the side walls 50 of the dielectric uniformly. Preferably the shield also covers the rearwardly facing shoulder 70 on dielectric flange 48.

Shell member 24 is then pushed onto the shield-wrapped dielectric 26 as far as it can go. This step can be facilitated by first placing the front end of the contact 28 against a firm surface.

Figure 4C:
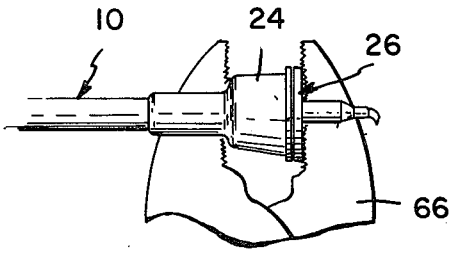

Pliers 66 are then used to press the dielectric completely into the shell member 26 as shown in FIG. 4*c*. Pressure is applied at intervals around the circumference to insure that the shell member flange 40 firmly abuts dielectric flange 48 with shield 16 squeezed therebetween. Nose 60 of the center contact 28 is now firmly squeezed with pliers 66 to crimp the contact about center conductor 12. The length of conductor protruding beyond nose 60 can be trimmed off to complete the assembly.

For optimum performance, coupling nut 22 should be torqued firmly onto a mating jack (not shown) to insure that the dielectric is properly seated in the shell member. FIG. 3 shows in cross-section an assembled UHF connector. Note that the steps 54 on dielectric side walls 50 provide points of high force concentration to enhance the conductivity between the braided shield 16 and the shell member 24.

FIG. 5 illustrates UHF connector 120 which is another embodiment of the present invention. Coupling nut 22 is unchanged. Shell member 124 has been changed to the extent of turning up the forward ends 300. The shell member still possesses a flange 140 to cooperate with coupling nut flange 32. Dielectric 126 has no flange and non-stepped side walls 150. The taper of the walls is about three degrees as with dielectric 26 to match taper of shell 124.

Center contact 128 has a slot 302 in its nose 160.

Generally the assembly of UHF connector 120 onto coaxial cable 10 is the same as that for connector 20. The end of center conductor 12 is bent into slot 302 to facilitate its termination therein.

FIG. 6*a* illustrates a field appliable UHF connector 220. Again the coupling nut for this connector is the same as coupling nut 22. Also the center contact 228 is the same as contact 28. Shell member 224 differs in that four tabs 304, 306, 308 and 310 are blanked out from its flange 240, each tab being spaced 90° from its neighbor. Dielectric 226 is the same as dielectric 26 except four slots 312 are provided on the circumference of its flange 248 at 90 degree increments. The inside wall 314 of each slot is preferably beveled. Prior to assembly all four tabs are in a position parallel to the connector's longitudinal axis. After dielectric 226 has been seated in shell member 224, opposing tabs 304 and 308 are bent inwardly against inside wall 314 of slots 312. Tabs 306 and 310 remain in an extended position and abut the jack (not shown) when the UHF connector is mated therewith. Tabs 304 and 308 serve to secure the dielectric 226 against forward movement.

FIG. 6*b* is a plan view looking down on top of the connector to better illustrate the above-described features.

FIGS. 7*a* and 7*b* illustrate a method of packaging the several components of UHF connector 20. This method requires that the dielectric 26 be molded so that a number of laterally extending tabs 316 be provided around the perimeter of flange 48. Without the braided shield, the dielectric 26 will slip into shell member 24 readily. While the dielectric is being held in the shell member, the coupling nut 22 is pushed over the tabs as shown to provide an interference fit therewith. This fit will hold the components together for shipment to the user.

FIG. 7*b* is a plan view taken along lines 7*b*—7*b* in FIG. 7*a* to better illustrate the above-described features.

The foregoing detailed description has been given for clearness of understanding only, and no unnecessary limitations should be understood therefrom, as some modifications will be obvious to those skilled in the art.

What is claimed is:

1. A field appliable UHF connector for use with coaxial cable of the type having a center conductor and a braided outer conductor, which comprises:

a. a shell member having a hollow, cup-shaped forward portion and an elongated rearward extension of less diameter than the forward portion, a passageway through said extension and opening into the forward portion, said passageway adapted to receive therethrough a coaxial cable, the walls of the forward portion converging rearwardly at an angle of from about three degrees to about six degrees, further, the forward portion having an outwardly extending radial flange on the leading edge of the forward portion;

b. a generally solid cup-shaped insulating body having a passageway therethrough to receive a contact therein, and further the side walls being tapered inwardly toward the base of the body and having one or more steps therearound, said body being adapted to be received within the forward portion of the shell member with the braided shield of the coaxial cable trapped therein between with the steps providing points of high force concentration against the braided shield;

c. an elongated center contact seated in the passage of the insulating body and adapted to receive the center conductor of the coaxial cable therein, said contact having securing means thereon comprising an upset intermediate its ends adapted to abut the forward face of the insulating body and the rear end of the contact flared outwardly to frictionally engage the walls of the passage in the insulating body, and further a nose of reduced diameter on its front end for insertion into a socket or the like; and d. a coupling nut rotatably positioned around the shell member and having internal threads therein for being threadably received by a threaded jack or the like.

2. The UHF connector of claim 1 wherein the degree of taper of said side walls on the insulating body approximates the degree of convergency of the walls of the forward portion of the shell member.

3. The UHF connector of claim 1 wherein the insulating body further includes an outwardly extending flange around its forward face, said flange being adapted to be positioned against the flange on the shell member with the braided shield therein between.

* * * * *